US006988527B2

(12) United States Patent
Savard et al.

(10) Patent No.: US 6,988,527 B2
(45) Date of Patent: Jan. 24, 2006

(54) PLUG FOR COUNTERBALANCING MECHANISM, DOOR ASSEMBLY INCLUDING THE SAME AND METHOD OF INSTALLING ASSOCIATED THERETO

(75) Inventors: Normand Savard, Drummondville (CA); Yannick Funk, Drummondville (CA)

(73) Assignee: Canimex Inc., Quebec (CA)

( * ) Notice: Subject to any disclaimer, the term of this patent is extended or adjusted under 35 U.S.C. 154(b) by 25 days.

(21) Appl. No.: 10/654,393

(22) Filed: Sep. 3, 2003

(65) Prior Publication Data

US 2004/0107643 A1 Jun. 10, 2004

(30) Foreign Application Priority Data

Sep. 3, 2002 (CA) ..... 2401084

(51) Int. Cl.
*E05F 15/00* (2006.01)

(52) U.S. Cl. ..... 160/191; 160/201; 160/318; 49/199

(58) Field of Classification Search ..... 160/191, 160/201, 318; 49/199
See application file for complete search history.

(56) References Cited

U.S. PATENT DOCUMENTS 3,038,535 A * 6/1962 Stroup et al. ..... 160/191
3,412,423 A * 11/1968 Binns ..... 16/198
3,615,065 A * 10/1971 Elliott ..... 242/375.1
5,865,235 A * 2/1999 Krupke et al. ..... 160/191
6,155,327 A * 12/2000 Wells et al. ..... 160/310
6,485,006 B1 * 11/2002 Beaudoin et al. ..... 267/155
6,502,281 B2 * 1/2003 Foucault et al. ..... 16/197
6,615,897 B2 * 9/2003 Dorma ..... 160/191
6,735,905 B1 * 5/2004 Miller ..... 49/200
6,742,564 B2 * 6/2004 Martin ..... 160/201
2001/0039761 A1 11/2001 Savard et al. ..... 49/199
2002/0043351 A1 4/2002 Foucault et al. ..... 160/201

* cited by examiner

*Primary Examiner*—Bruce A. Lev
(74) *Attorney, Agent, or Firm*—Merchant & Gould P.C.

(57) ABSTRACT

A plug for operatively connecting a torsion spring onto a corresponding component of a counterbalancing mechanism of a door assembly. The plug includes a connecting portion for removably connecting the plug onto the corresponding component, a substantially cylindrical collar insertable into an end portion of the torsion spring, an anchoring portion disposed on a bottom section of the collar for cooperating with a coil of the end portion of the torsion spring so as to pivotally anchor the collar onto the end portion of the torsion spring, and a clip projecting from a top section of the collar, and being disposed at a location on the collar substantially diametrically opposite from where the anchoring portion is disposed on the bottom section of the collar. The clip is shaped and sized for clasping past an end coil of the torsion spring and operatively engaging with the same so as to securely mount the plug onto the end portion of the torsion spring in a clip-like manner, thereby enabling the plug to be mounted onto the torsion spring quickly and easily.

16 Claims, 9 Drawing Sheets

PLUG FOR COUNTERBALANCING MECHANISM, DOOR ASSEMBLY INCLUDING THE SAME AND METHOD OF INSTALLING ASSOCIATED THERETO

FIELD OF THE INVENTION

The present invention relates to a plug, also known as a cone, an anchor, or a collar, as used in counterbalancing mechanisms of door assemblies, such as garage doors and the like. The present invention also relates to a counterbalancing mechanism provided with such a plug, to the door assembly including the same, as well as to a method of installing the plug onto the counterbalancing mechanism. The present invention is particularly advantageous in that it enables to facilitate the installation of a plug onto a torsion spring of a counterbalancing mechanism, for operatively connecting the torsion spring onto a corresponding component of the counterbalancing mechanism, so as to or allow a proper torque transfer between the torsion spring and the corresponding component. The present invention may also be used in other situations requiring the attachment of a torsion spring onto a corresponding component of another type of mechanism or assembly.

BACKGROUND OF THE INVENTION

It is known in the art that door assemblies, such as commercial and residential garage doors, rolling steel doors, and the like, for example, usually require counterbalancing mechanisms to counterbalance the weight of the door in order to decrease the force required to open the door and also facilitate its closing from a raised to a lowered position. Door assemblies may be manually or power operated, but in either case, particularly for manually operated doors, counterbalancing mechanisms have been used for many years to counterbalance the weight of the door and control its opening and closing movements so that one person can easily control the operation of the door. Counterbalancing mechanisms are also advantageous for power operated door assemblies since they reduce the power requirements needed for the motor and they lower the structural strength required for the opening and closing mechanism of the door. In other words, lighter weight, lower cost, door controlling mechanisms may be used if a counterbalancing mechanism is connected to the door to assist it in its opening and closing movements. Furthermore, the provision of a counterbalancing mechanism minimizes the chance of a rapid and uncontrolled closing of the door in the event of failure of one of the components of the door controlling mechanism, which can result in personal injury or damage to property.

It is also known in the art that a widely used type of counterbalancing mechanism 3, as used for a typical cable-operated door assembly such as the one illustrated in FIG. 1 for example, generally comprises a pair of spaced apart cable drums 5 connected to flexible cables 7, each cable 7 being in turn connected to a lower opposite side edge of the garage door 9. The cable drums 5 are usually mounted on an overhead shaft 11 which is supported above the door opening and is connected to one or more torsion springs 13 which are each fixed to the shaft 11 at one end, and secured to the wall at the other end, so that the cable drums 5 are biased to rotate in a direction which winds the cables 7 onto the drums and counteracts the weight of the door connected to the cables 7. Generally, conventional counterbalancing mechanisms 3 include two torsion springs 13 which are usually coaxially mounted onto the overhead shaft 11 and which are opposed to one another. Furthermore, the torsion springs 13 are adjusted by applying tension therein to properly balance the weight of the door 9 so that minimal opening and closing efforts are required, either manually or when motor controlled. The two drums 5 which are used for winding the cables 7 are usually fastened at each opposite end of the overhead shaft 11 and are fixed to the same by means of screws, whose respective ends are in contact with the shaft 11 and exert pressure thereon.

It is also known in the art that conventional, low cost adjustment devices used for the above-mentioned type of counterbalancing mechanisms, and widely utilized in the garage door industry and others, are generally cylindrical "collars" commonly referred to also as "plugs" 15 (or "cones", "anchors", etc.) which are connected to the so-called fixed ends of the torsion springs 13 and are mounted on the aforementioned shaft 11 for adjusting the deflection of the springs to preset the counterbalancing force. That is, each torsion spring 13 is usually coaxially mounted onto the overhead shaft 11 and is preferably connected with a stationary plug 15*a* at one end and a winding plug 15*b* at the other end. Usually, stationary plugs 15*a* are operatively connected to a fixed structure, such as for example, a support bracket 17 rigidly mounted to the wall. Moreover, winding plugs 15*b* are usually removably fixed to the overhead shaft 11 and are used to operatively connect the torsion spring 13 to the overhead shaft 11 so as to allow a torque transfer between the latter two. Hence, the above-mentioned plugs 15 ensure a mechanical connection between each opposite end of the torsional spring 13 and the support or a shaft, depending on whether they are respectively stationary plugs 15*a* or winding plugs 15*b*. The winding plugs 15*b* usually include one or more setscrews which lock the plugs to the shaft to prevent rotation therewith except during adjustment of the torsion spring. The winding plugs 15*b* also typically include sockets for receiving winding bars whereby the springs are often preset, or "preloaded", manually, by rotating the winding plugs 15*b* with respect to the shaft 11 using the winding bars and then locking the winding plugs to the shaft 11 with the setscrews.

Thus, garage doors, rolling steel doors, mini-warehouse doors, and the like, as shown in FIG. 1, usually comprise counterbalancing mechanisms 3 to counterbalance the weight of the door 9 in order to decrease the force required to open such door 9 and also facilitate (e.g. control) its closing from a raised to a lowered position. As previously mentioned, in most counterbalancing mechanisms of most door assemblies, whether cable-operated or not, each torsion spring 13 is usually coaxially mounted onto an overhead shaft 11 and is preferably connected with a "stationary plug" 15*a* at one end and a "winding plug" 15*b* at the other end. Usually, stationary plugs 15*a* are connected to a fixed structure, such as for example, a support bracket 17 rigidly mounted to the wall. Winding plugs 15*b* are usually removably fixed to the overhead shaft 11 by means of suitable fasteners and are used to operatively connect the torsion spring 13 to the overhead shaft 11 so as to allow a torque transfer between the latter two.

FIGS. 2 and 3 show perspective views of stationary plugs 15*a* according to different embodiments of the prior art, and FIG. 4 shows a side view of stationary and winding plugs being shown cooperating respectively with an extremity of a torsion spring 13 mounted about an overhead shaft 11 of a counterbalancing mechanism 3 according to the prior art.

As is known in the art and as can be easily understood when referring to FIGS. 2–4, the ends of the torsion spring 13 are generally attached onto the plug 15 by either a)

positioning a portion of the end of the torsion spring about the collar 19 of the plug and hooking a bent extremity of the spring 13 onto a corresponding hooking slot 21 of the plug 15, such as the one shown in FIG. 2, or b) by placing the plug 15 against the end of the spring 13 and screwing the threaded plug collar 19 into the spring, with a plug 15 such as the one shown in FIG. 3. This is particularly disadvantageous in that the above-mentioned way of connecting a conventional plug 15 onto a torsion spring 13 is relatively time-consuming, and very often requires substantial physical effort and/or specific tooling.

Also known in the art are the following U.S. patents and patent applications which describe various devices and methods for use with counterbalancing mechanisms of door assemblies:

U.S. Pat. No. 6,174,575 B1 (FOUCAULT et al.); U.S. Pat. No. 6,502,281 B2 (FOUCAULT et al.); U.S. Pat. No. 6,485,006 B1 (BEAUDOIN et al.); U.S. Pat. No. 6,327,744 B1 (DORMA); U.S. Pat. No. 6,263,541 B1 (SCATES); U.S. Pat. No. 6,174,575 B1 (FOUCAULT et al.); U.S. Pat. No. 6,134,835 (KRUPKE et al.); U.S. Pat. No. 6,125,582 (MONDRAGON et al.); U.S. Pat. No. 5,865,235 (KRUPKE et al.); U.S. Pat. No. 5,636,678 (CARPER et al.); U.S. Pat. No. 4,519,556 (TIMOSCHUK); 2003/0094248 A1 (MITCHELL); 2002/0043351 A1 (FOUCAULT et al.); 2001/0039761 A1 (SAVARD et al.).

None of the above-mentioned documents seems to describe a plug which by virtue of its design and components, enables to be installed quickly and easily onto the end portion of a torsion spring in a clip-like manner, so as to operatively connect the torsion spring onto a corresponding component of the counterbalancing mechanism, and thus enable a suitable torque transfer between the two via the plug.

Hence, in light of the aforementioned, there is a need for an improved device and/or method for operatively connecting a torsion spring onto a corresponding component of a counterbalancing mechanism, which would be able to overcome some of the aforementioned problems.

SUMMARY OF THE INVENTION

The object of the present invention is to provide a plug which, by virtue of its design and components, satisfies some of the above-mentioned needs and is thus an improvement over other known plugs and/or methods in the prior art.

The present invention is particularly advantageous in that it may be inserted onto a spring without screwing.

In accordance with the present invention, the above object is achieved with a plug for a counterbalancing mechanism of a door assembly, the counterbalancing mechanism comprising a torsion spring, said torsion spring having a plurality coils, and an end portion including an end coil and a preceding coil adjacent to said end coil, the plug being used for operatively connecting the end portion of the torsion spring onto a corresponding component of the counterbalancing mechanism for allowing a torque transfer between the torsion spring and said corresponding component, the plug comprising:

connecting means for removably connecting the plug onto the corresponding component of the counterbalancing mechanism;

a substantially cylindrical collar insertable into the end portion of the torsion spring, the collar having a longitudinal axis and a peripheral side area extending about the longitudinal axis, the peripheral side area including diametrically opposite top and bottom portions;

anchoring means disposed on the bottom portion of the peripheral side area of the collar for cooperating with a coil of the end portion of the torsion spring so as to pivotably anchor the collar onto said end portion of the torsion spring; and a clip projecting from the top portion of the peripheral side area of the collar, at a location on the collar substantially diametrically opposite from where the anchoring means are disposed on the bottom portion of the peripheral side area, the clip being shaped and sized for clasping past the end coil of the torsion spring and operatively engaging with said end coil so as to securely mount the plug onto the end portion of the torsion spring in a clip-like manner.

According to another aspect of the present invention, there is also provided a counterbalancing mechanism comprising a torsion spring, said torsion spring having a plurality coils, and an end portion including an end coil and a preceding coil adjacent to said end coil, the counterbalancing mechanism further comprising a plug used for operatively connecting the end portion of the torsion spring onto a corresponding component of the counterbalancing mechanism for allowing a torque transfer between the torsion spring and said corresponding component, the plug comprising:

connecting means for removably connecting the plug onto the corresponding component of the counterbalancing mechanism;

a substantially cylindrical collar insertable into the end portion of the torsion spring, the collar having a longitudinal axis and a peripheral side area extending about the longitudinal axis, the peripheral side area including diametrically opposite top and bottom portions;

anchoring means disposed on the bottom portion of the peripheral side area of the collar for cooperating with a coil of the end portion of the torsion spring so as to pivotably anchor the collar onto said end portion of the torsion spring; and a clip projecting from the top portion of the peripheral side area of the collar, at a location on the collar substantially diametrically opposite from where the anchoring means are disposed on the bottom portion of the peripheral side area, the clip being shaped and sized for clasping past the end coil of the torsion spring and operatively engaging with said end coil so as to securely mount the plug onto the end portion of the torsion spring in a clip-like manner.

According to another aspect of the present invention, there is also provided a door assembly having a counterbalancing mechanism comprising a torsion spring, said torsion spring having a plurality coils, and an end portion including an end coil and a preceding coil adjacent to said end coil, the door assembly further having a plug used for operatively connecting the end portion of the torsion spring onto a corresponding component of the counterbalancing mechanism for allowing a torque transfer between the torsion spring and said corresponding component, the plug comprising:

connecting means for removably connecting the plug onto the corresponding component of the counterbalancing mechanism;

a substantially cylindrical collar insertable into the end portion of the torsion spring, the collar having a longitudinal axis and a peripheral side area extending about the longitudinal axis, the peripheral side area including diametrically opposite top and bottom portions;

anchoring means disposed on the bottom portion of the peripheral side area of the collar for cooperating with a coil of the end portion of the torsion spring so as to pivotably anchor the collar onto said end portion of the torsion spring; and a clip projecting from the top portion of the peripheral side area of the collar, at a location on the collar substantially diametrically opposite from where the anchoring means are disposed on the bottom portion of the peripheral side area, the clip being shaped and sized for clasping past the end coil of the torsion spring and operatively engaging with said end coil so as to securely mount the plug onto the end portion of the torsion spring in a clip-like manner.

According to yet another aspect of the present invention, there is also provided a method for operatively connecting a torsion spring onto a corresponding component of a counterbalancing mechanism of a door assembly, for allowing a torque transfer between the torsion spring and said corresponding component, the torsion spring having a plurality of coils, and an end portion including an end coil and a preceding coil adjacent to said end coil, the method comprising the steps of:

a) providing a plug such as the one described and exemplified herein;

b) anchoring the anchoring means of the plug onto a coil of the end portion of the torsion spring so as to pivotably anchor the collar of the plug onto said end portion of the torsion spring;

c) pivoting the collar of the plug about its anchoring means so as to rest the clip of the plug against the end coil, at a location on the end coil substantially diametrically opposite to where the anchoring means of the plug are inserted in step a);

d) clasping the clip of the collar past the end coil of the torsion spring and engaging with the same so as to securely mount the plug onto the end portion of the torsion spring in a clip-like manner; and e) connecting the plug onto the corresponding component of the counterbalancing mechanism for allowing a torque transfer between the torsion spring and said corresponding component.

Preferably, step d) comprises the step of i) bending an extremity of the end coil into a slot of the collar. Preferably also, step i) comprises the step of heating the extremity of the end coil prior to bending it into the slot.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
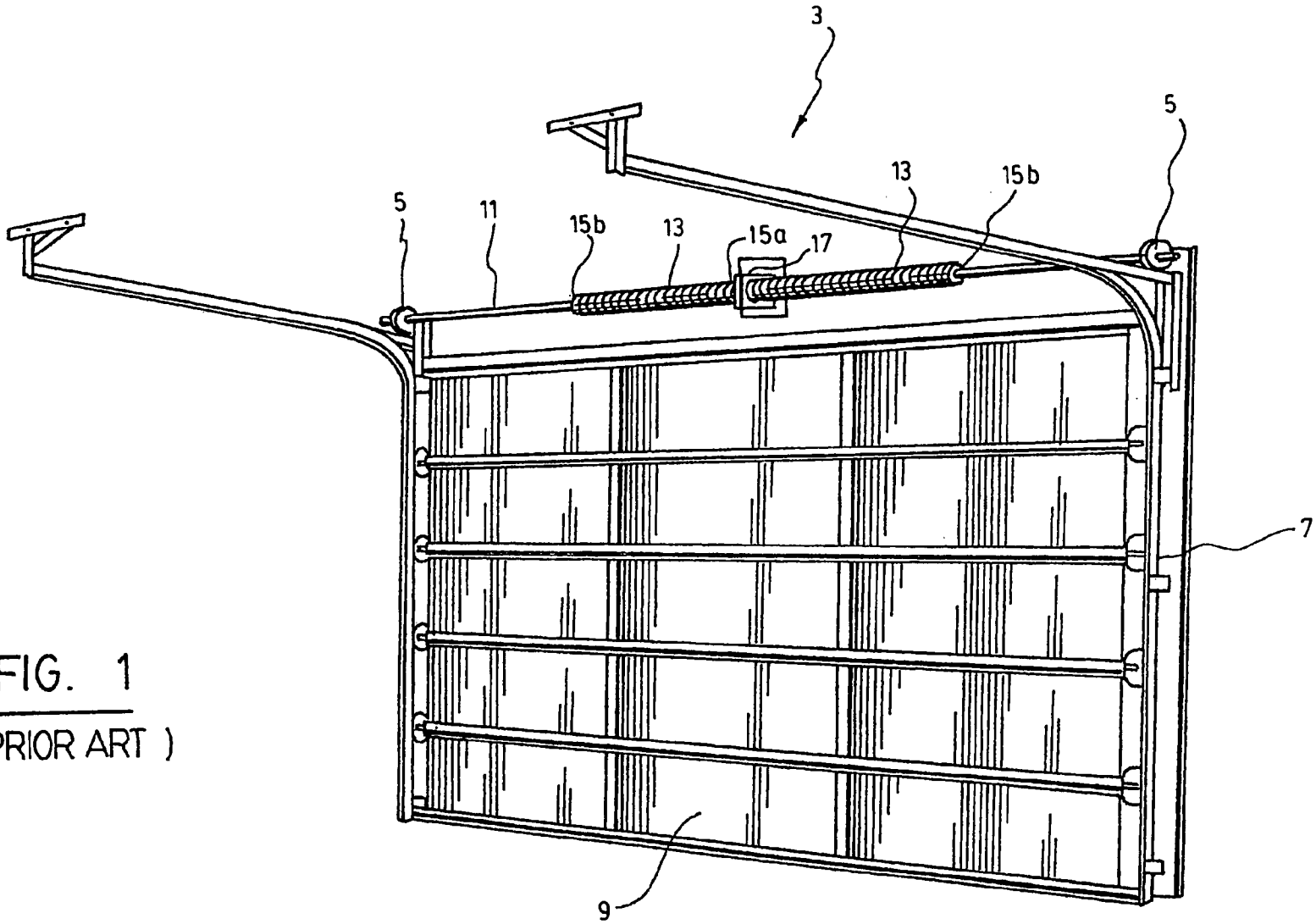
FIG. 1 ( PRIOR ART )
FIG. 1 is a perspective view of a typical door assembly connected to a counterbalancing mechanism provided with stationary and winding plugs according to the prior art.

In the following description, the same numerical references refer to similar elements. The embodiments shown in FIGS. 5–13 are preferred.

In the context of the present description, the expression "door assembly" includes various types of door assemblies, such as rolling door assemblies (e.g. mini-warehouse doors, commercial rolling steel doors, etc.) and the like. Although the present invention was primarily designed for a garage door assembly, it may be used with other kinds of assemblies, such as fire doors or shutters, or with any other door assemblies provided with counterbalancing, winding, and/or controlling mechanisms requiring a torsion spring to be connected to a corresponding component, as apparent to a person skilled in the art. For this reason, the expression "counterbalancing" and/or "door assembly" should not be taken as to limit the scope of the present invention and includes all other kinds of assemblies or items with which the present invention may be used and could be useful.

Moreover, in the context of the present description, the expressions "door" and "assembly", "plug" and "collar", "counterbalancing" and "controlling", "mechanism" and "system", "winding" and "counterbalancing", as well as any other equivalent expressions and/or compound words thereof, may be used interchangeably. The same applies for any other mutually equivalent expressions, such as "plate" and "bracket" for example, as apparent to a person skilled in the art.

In addition, although the preferred embodiment of the present invention as illustrated in the accompanying drawings comprises various components such as a groove, a slot, a flange, stopper(s), an end covering, socket(s), orifice(s), etc., and although the preferred embodiment of the plug 101 and corresponding parts of the present invention as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the plug 101 according to the present invention, as will be briefly explained herein and as can be easily inferred herefrom, without departing from the scope of the invention.

Broadly described, the plug 101 according to the present invention, as exemplified in the accompanying drawings, is a plug 101 (also known as "anchor", "collar" or "cone") which is devised for facilitating the installation thereof onto a torsion spring 113 of a counterbalancing mechanism 103 of a door assembly. More particularly, the plug 101 is to be used with a counterbalancing mechanism 103 of a door assembly, the counterbalancing mechanism 103 comprising a torsion spring 113, and the torsion spring having a plurality of coils, and an end portion 105 including an end coil 107 and a preceding coil 109 adjacent to said end coil 107, as better shown in FIGS. 7–10. The plug 101 is used for operatively connecting the end portion 105 of the torsion spring 113 onto a corresponding component (not shown) of the counterbalancing mechanism 103 for allowing a torque transfer between the torsion spring 113 and said corresponding component, as is typically in most counterbalancing, controlling, and/or winding mechanisms 103 of door assemblies and the like.

Typically, the corresponding component is an overhead shaft 11 of the counterbalancing mechanism 103 if the plug 101 acts as a winding plug 101*b*, whereas the corresponding component may also be a support bracket 17 for example, operatively connected to a fixed structure, such as a wall for example, when the plug 101 acts as a stationary plug 101*a*. It is worth mentioning though, as apparent to a person skilled in the art, that the plug 101 according to the present invention may be used for operatively connecting the end portion 105 of a torsion spring 113 of a given mechanism 103 onto any other type of corresponding component of the given mechanism 103 other than the ones described herein, so long as a torque transfer is required between the torsion spring 113 and the corresponding component, whatever said corresponding component may consist of within the mechanism 103, as apparent to a person skilled in the art.

Figure 6:
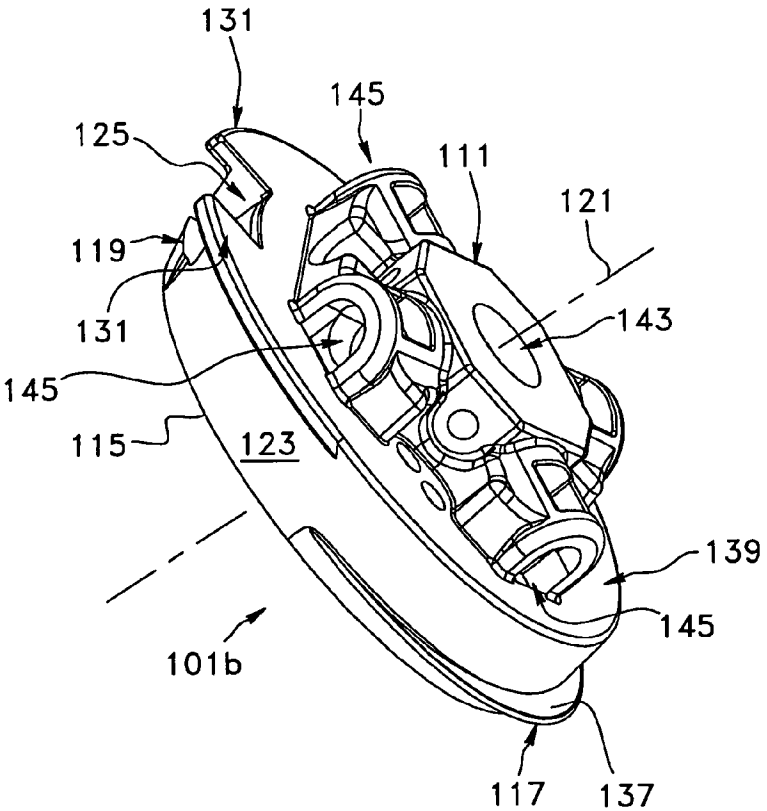
FIG. 6 is perspective view of a plug according to another preferred embodiment of the present invention.
Figure 5:
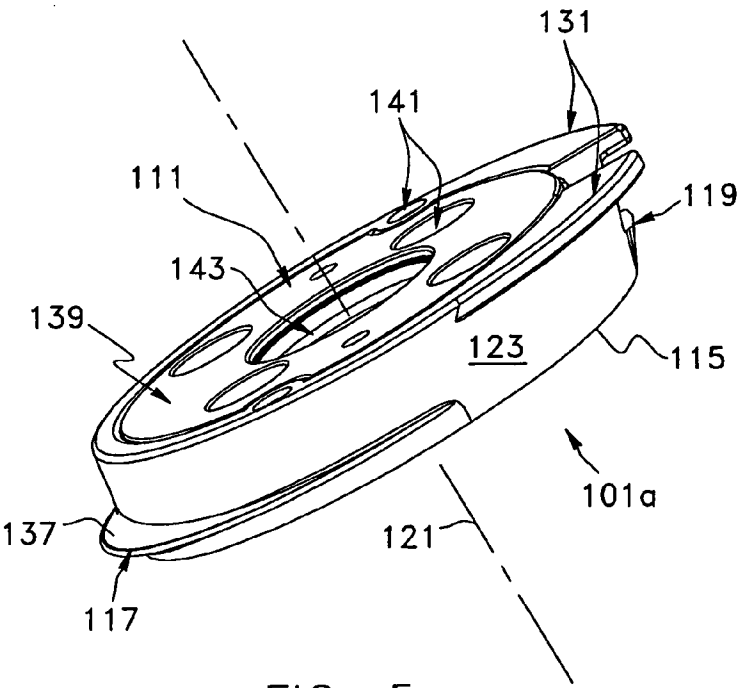
FIG. 5 is a perspective view of a plug according to a preferred embodiment of the present invention.

As better shown in FIGS. 5 and 6, the plug 101 according to the present invention comprises connecting means 111, a collar 115, anchoring means 117, and a clip 119. The connecting means 111 are used for removably connecting the plug 101 onto the corresponding component of the counterbalancing mechanism 103. The collar 115 is preferably substantially cylindrical and is devised to be insertable into the end portion 105 of a torsion spring 113, and has a longitudinal axis 121 and a peripheral side area 123 extending about the longitudinal axis, as also better shown in FIGS. 5 and 6.

The anchoring means 117 are disposed on the bottom portion of the peripheral side area 123 of the collar 115 for cooperating with a coil of the end portion 105 of the torsion spring 113 so as to pivotally anchored the collar 115 onto said end portion 105 of the torsion spring 113, as can be easily understood when referring to FIGS. 7–10.

As better shown in FIGS. 5–10, the clip 119 of the plug 101 preferably projects from the peripheral side area 123 of the collar 115, at a location on the collar 115 substantially diametrically opposite from that where the anchoring means 117 are disposed on the bottom portion of the peripheral side area 123. The clip 119 is preferably shaped and sized for clasping past the end coil 107 of the torsion spring 113 and operatively engaging with the same, as better shown in FIG. 10, so as to securely mount the plug 101 onto the end portion 105 of the torsion spring 113 in a clip-like manner, as can be easily understood when referring from FIGS. 7–10. This is particularly advantageous in that it enables the plug 101 to be mounted quickly and easily onto the torsion spring 113 of the counterbalancing mechanism 103, without the need for screwing for example, which is very time-consuming and physically demanding.

Referring to FIGS. 5 and 6, there are shown two examples of plugs 101 according to the present invention, the plug 101 shown in FIG. 5 being a "stationary plug" 101*a* and the plug 101 being shown in FIG. 6 being a "winding plug" 101*b*, both to be installed on respective ends of the spring 113, as aforementioned. Each plug 101, whether stationary or winding, has essentially the same or similar features for insertion (or cooperation) at the corresponding end portion 105 of the spring 113. Indeed, each plug 101 has anchoring means 117, which preferably consist of a flange, a tab, or a wing, projecting on one side of the collar 115, and an opening on the other side of the collar 115. A clip 119 extends in front of the opening and is adapted for spring insertion as briefly described hereinafter.

As better shown in the accompanying drawings, the plug 101 according to the present invention preferably comprises a groove 125 (i.e. opening) disposed on the top portion of the peripheral side area 123 of the collar 115 and positioned adjacent to the clip 119, as better illustrated in FIGS. 5–9. The groove 125 is preferably shaped and sized for receiving a segment of the end coil 107 of the torsion spring 113 when the clip 119 is clasped past the end coil 107 and operatively engaged therewith, as can be easily understood when referring to FIGS. 8–10.

Figure 11:
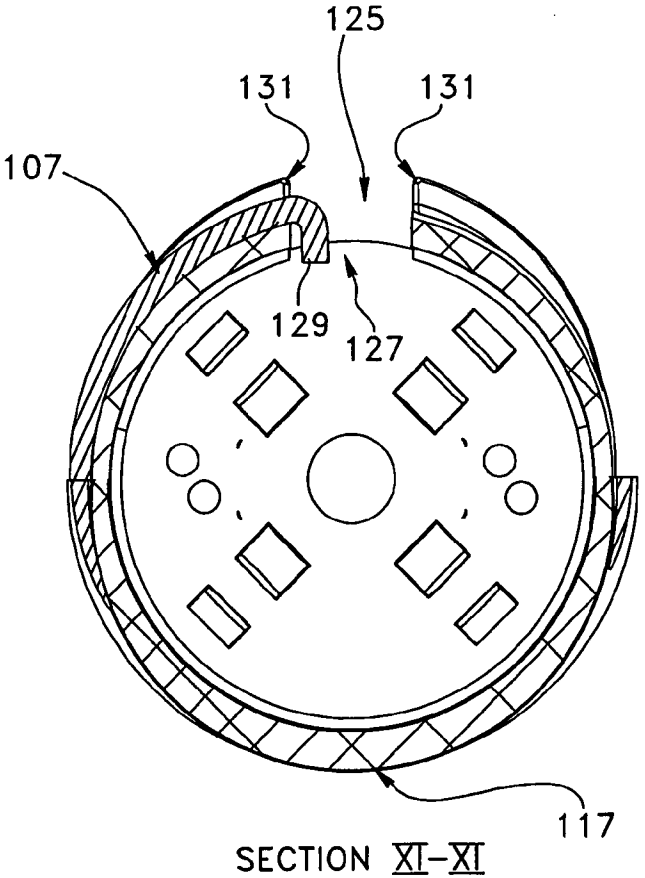
FIG. 11 is a cross-sectional view taken along line XI—XI of the plug-spring assembly shown in FIG. 10.

As better shown in FIG. 11, the plug 101 preferably further comprises a slot 127 operatively connected to the groove 125, the slot extending inside the collar 115 towards the longitudinal axis 121 thereof, for receiving an extremity 129 of the end coil 107 to be bent into said slot 127, as illustrated.

Referring back to FIGS. 5–10, the plug 101 preferably further comprises at least one stopper 131 projecting from the top portion of the peripheral side area 123 of the collar, positioned adjacent to the groove 125, for abutting against the end coil 107 of the torsion spring 113, when the clip 119 is clasped past the end coil 107.

Figure 7:
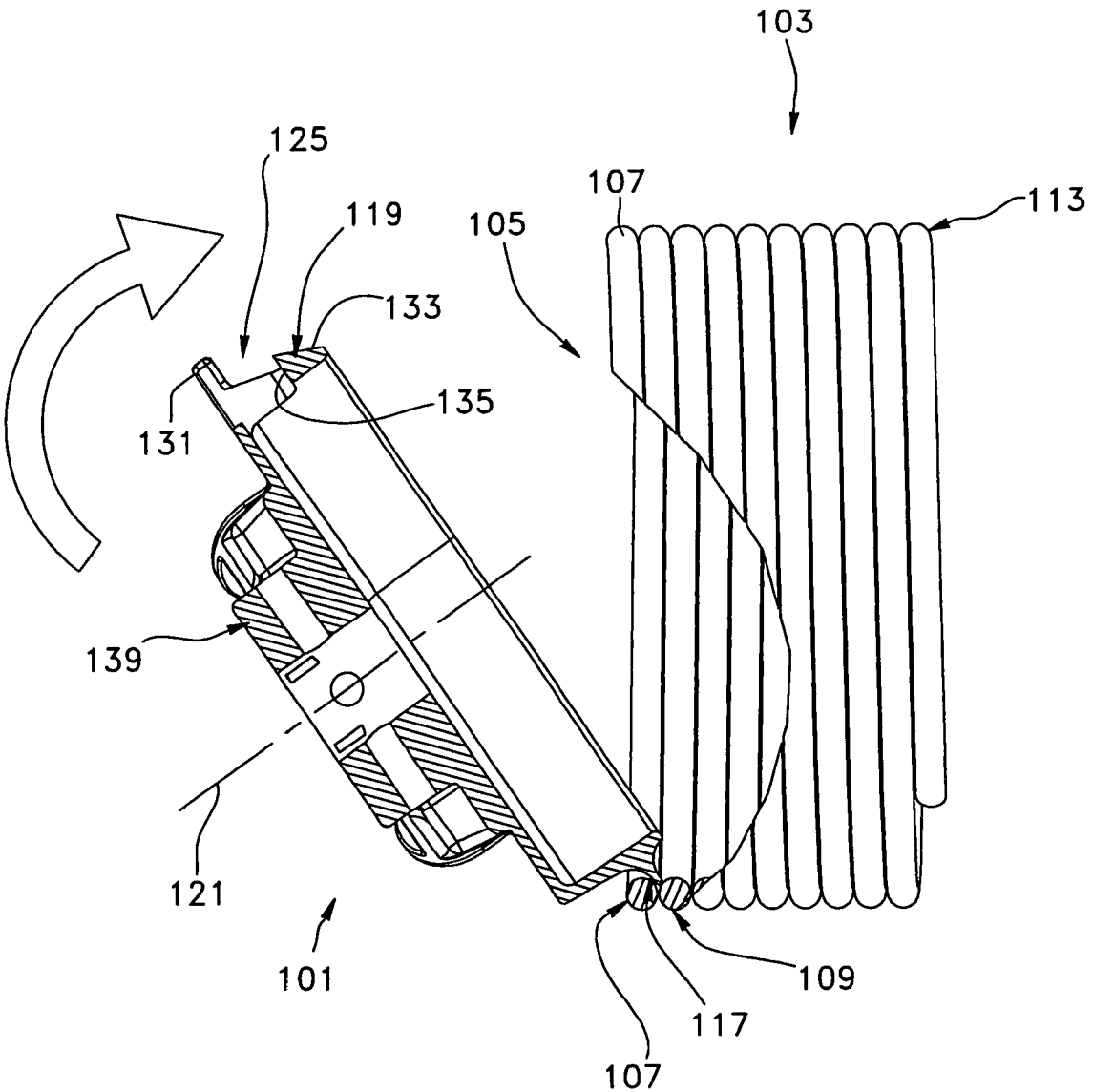
FIGS. 7–10 are different side views showing installation stages of a plug onto an end portion of a torsion spring according to the present invention.
Figure 8:
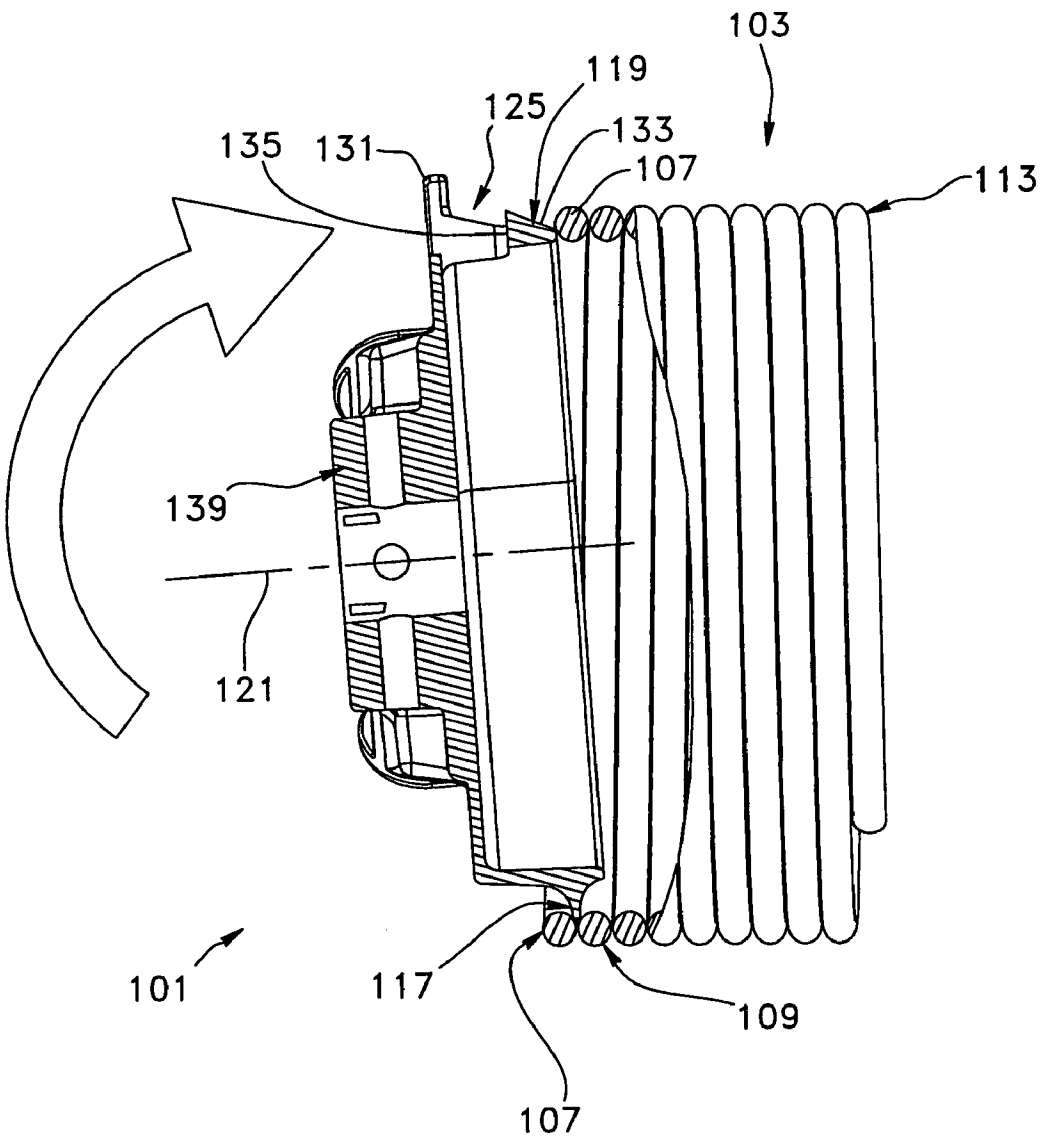
Figure 9:
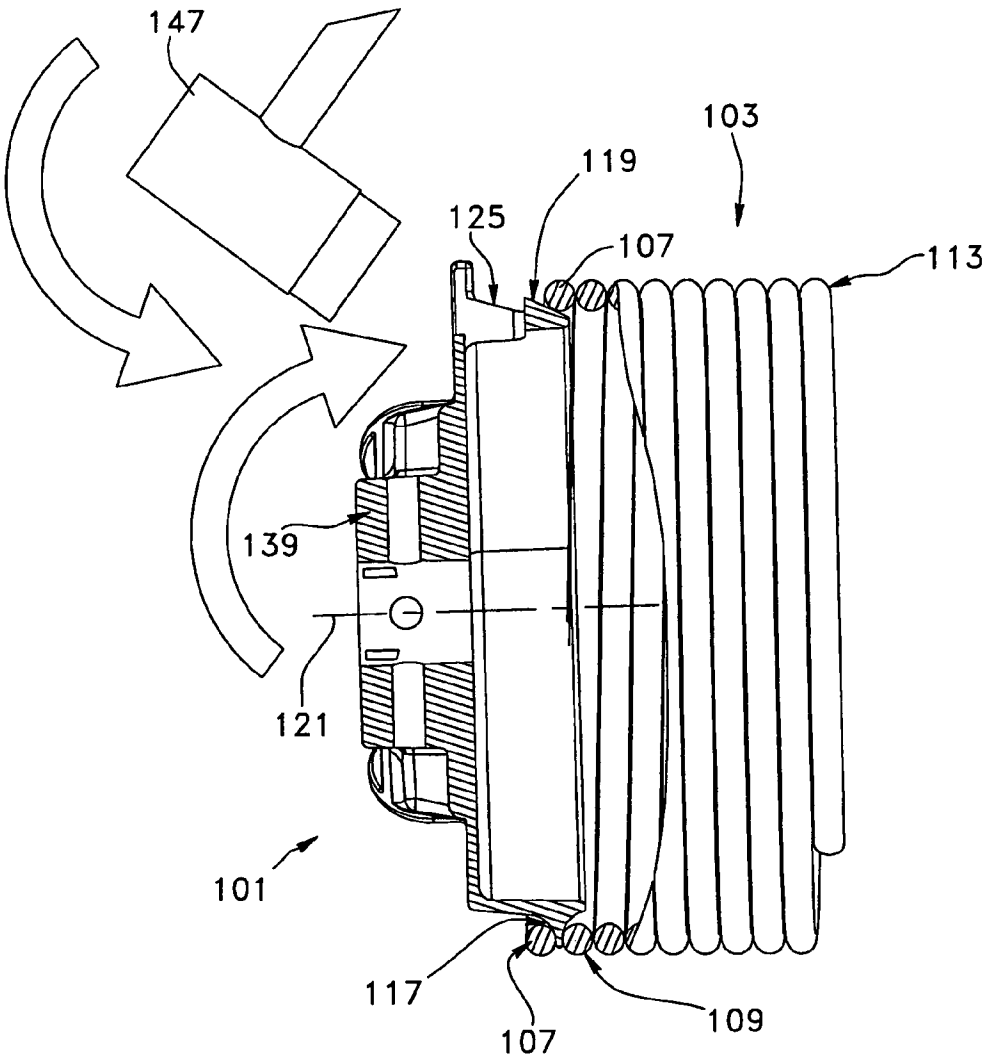

Referring now particularly to FIGS. 7–9, the clip 119 preferably comprises a wedge-like element having a slanted portion 133 shaped and sized for pressure insertion into the end portion 105 of the torsion spring 113 past the end coil 107 thereof. The wedge-like element preferably also has a hooking portion 135 opposite to the slanted portion 133 for engaging with the end coil 107 once the slanted portion 133 is inserted past the end coil 107, as also better shown in FIG. 10.

According to the preferred embodiment of the present invention, the anchoring means 117 preferably comprise a flange 137 projecting from the bottom portion of the peripheral side area 123 of the collar 115, at a location on the collar 115 substantially diametrically opposite from where the clip 119 projects from the top portion of the peripheral side area 123, the flange 137 being shaped and sized for insertion between the end coil 107 and the preceding coil 109 of the end portion 105 of the torsion spring 113 so as to pivotally anchor the collar 115 onto said end portion 105 of the torsion spring 113, as can be easily understood when referring to FIGS. 7–10.

As better shown in FIGS. 7 and 8, the flange 137 of the plug 101 is preferably substantially tapered for facilitating insertion of the flange 137 at an angle between the end coil 107 and the preceding coil 109 of the end portion 105 of the torsion spring 113.

It is worth mentioning though that according to the present invention, the anchoring means 117 may take on various other suitable embodiments so long as they enable the collar 115 of the plug 101 to be pivotally anchored onto the end portion 105 of the torsion spring 113, as apparent to a person skilled in the art. For example, instead of a flange 137, the anchoring means 117 may comprise a groove (not shown) disposed on the bottom portion of the peripheral side area 123 of the collar 115, at a location on the collar 115 substantially diametrically opposite from where the clip 119 projects from the top portion of the peripheral side area 123, the groove being shaped and sized for receiving a segment of the end coil 107 of the torsion spring 113 so as to pivotally anchor the collar 115 onto said end portion 105 of the torsion spring 113. Moreover, it is worth mentioning that according to another embodiment of the present invention, the anchoring means 117 could consist of an additional clip which would cooperate with the end portion 105 of the torsion spring 113 in a manner very similar to that of the above-described first clip 119, as apparent to a person skilled in the art. Indeed, a main objective of the present invention is to provide a plug 101 whose components and design enable it to be securely mounted onto the end portion 105 of a torsion spring 113 in a clip-like manner, irrespectively of the shape or form that its corresponding clip 119 and/or anchoring means 117 may take on, as apparent to a person skilled in the art.

Moreover, it is worth mentioning that according to the present invention, the collar 115 of the plug 101 need not be substantially symmetrical and/or cylindrical in order for it to carry out its proper functions. Indeed, the collar 115 of the plug 101 according to the preferred embodiments of the present invention is preferably made cylindrical in order to substantially match the corresponding conventional shape of the torsion spring 113 into which the collar 115 is inserted, but it is worth mentioning that the collar 115 may take on various other suitable cross-sectional configurations so long as it is provided with a peripheral side area 123 having substantially opposite top and bottom portions, located on either side of the longitudinal axis 121 of the collar 115, so as to enable a clip 119 and anchoring means 117 to be disposed respectively on said top and bottom portions, in order to enable the plug 101 to be mounted onto the end portion of the torsion spring in a clip-like manner, as above-discussed, and as apparent to a person skilled in the art.

As better shown in FIGS. 5–6 and 12–13, the collar 115 preferably comprises an end covering 139 provided with at least one hole 141 for receiving a corresponding fastener for fastening the plug 101 onto the corresponding component of the counterbalancing mechanism 103. Preferably also, according to the preferred embodiment of the present invention, the end covering 139 preferably comprises an orifice 143 for receiving therethrough a shaft (e.g. overhead shaft) of the counterbalancing mechanism 103, as can be easily understood from a person skilled in the art. Moreover, if the plug 101 according to the present invention acts as a winding plug 101*b*, the end covering 139 preferably is provided with at least one socket 145 for receiving a winding tool, such as a winding bar for example, as is well known in the art.

Preferably, the various components of the plug 101, such as the connecting means 111, the collar 115, the anchoring means 117, the clip 119, etc., are made of one single piece and of one single material. Various manufacturing processes (molding, casting, and the like) and various suitable corresponding materials may be used for fabricating the plug 101 according to the present invention, as apparent to a person skilled in the art. Preferably, the plug 101 is made of a suitable rigid material, such as a metallic material (e.g. steel, etc.), or a hardened polymer, although other suitable materials, such as composite materials, etc., may be used depending on the particular applications for which the plug 101 is intended, and the loads it is subject to, as also apparent to a person skilled in the art.

According to another aspect of the present invention, there is also provided a counterbalancing mechanism 103 provided with the above-described plug 101. According to yet another aspect of the present invention, there is also provided a door assembly having a counterbalancing mechanism 103 provided with the above-described plug 101. According to yet another aspect of the present invention, there is also provided a method of installing the above-described plug 101 onto corresponding components of a counterbalancing mechanism 103.

Indeed, according to the present invention, there is provided a method for operatively connecting a torsion spring 113 onto a corresponding component of a counterbalancing mechanism 103 of a door assembly, for allowing a torque transfer between the torsion spring 113 and said corresponding component, the torsion spring 113 having a plurality of coils, and an end portion 105 including an end coil 107 and a preceding coil 109 adjacent to the end coil 107. The method comprises the steps of a) providing a plug 101 according to the present invention, such as the one described and exemplified herein; b) anchoring the anchoring means 117 of the plug 101 onto a coil of the end portion 105 of the torsion spring 113 so as to pivotally anchor the collar 115 of the plug 101 onto said end portion 105 of the torsion spring 113; c) pivoting the collar 115 of the plug 101 about its anchoring means 117 so as to rest the clip 119 of the plug 101 against the end coil 107, at a location on the end coil 107 substantially diametrically opposite to where the anchoring means 117 of the plug 101 are inserted in step a); and d) clasping the clip 119 of the collar 115 past the end coil 107 of the torsion spring 113 and engaging with the same so as to securely mount the plug 101 onto the end portion 105 of the torsion spring 113 in a clip-like manner; and e) connecting the plug 101 onto the corresponding component of the counterbalancing mechanism 103 for allowing a torque transfer between the torsion spring and said corresponding component.

Preferably, step d) comprises the step of bending an extremity 129 of the end coil 107 into the slot 127 of the collar 115. Preferably also, this last step preferably comprises the step of heating the extremity 129 of the end coil 107 prior to bending it into the slot 127. It is worth mentioning that depending on the particular configuration of the plug 101, the end coil 107 could have its extremity 129 bent before or after the plug 101 is mounted onto the torsion spring, as will be briefly described hereinafter.

According to a preferred embodiment of the present invention, and in normal use, the flange 137 of the plug 101 is first inserted between the last coil 107 of the spring and the coil 109 before, as better shown in FIG. 7. The plug is then pivoted around this insertion point, to bring the wedge-like element in contact with the other side of the coil 107, as better shown in FIG. 8. Once in contact, a user (installer, operator, etc.) taps the plug covering 139 with an appropriate tool 147, such as a hammer for example. The flange 137 is thereby urged between both coils 107, 109, causing them to open while the other side of the coil 107 slips over the wedge-like element, as can be understood from FIGS. 9 and 10.

Figure 10:
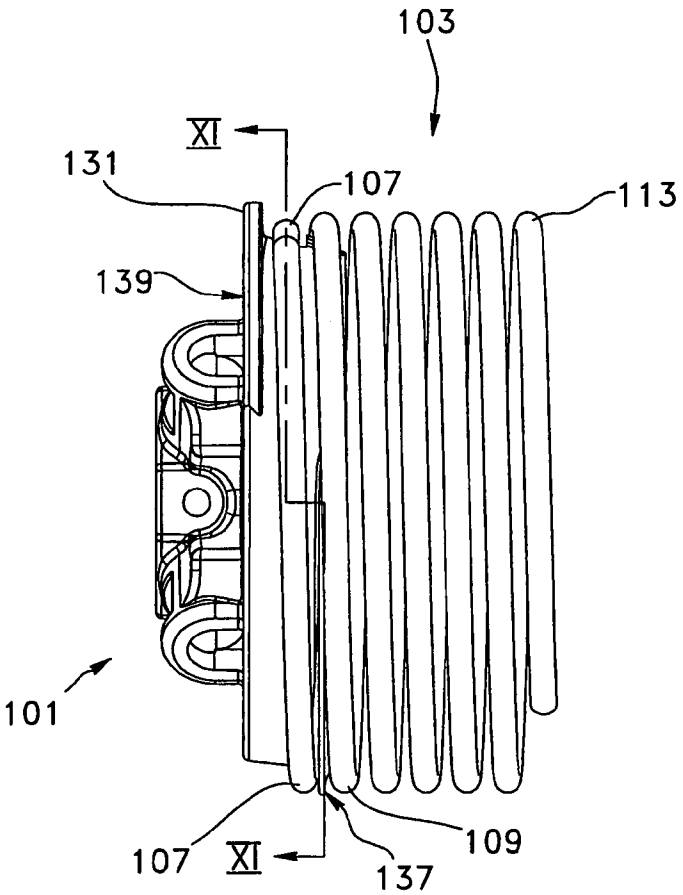
Figure 13:
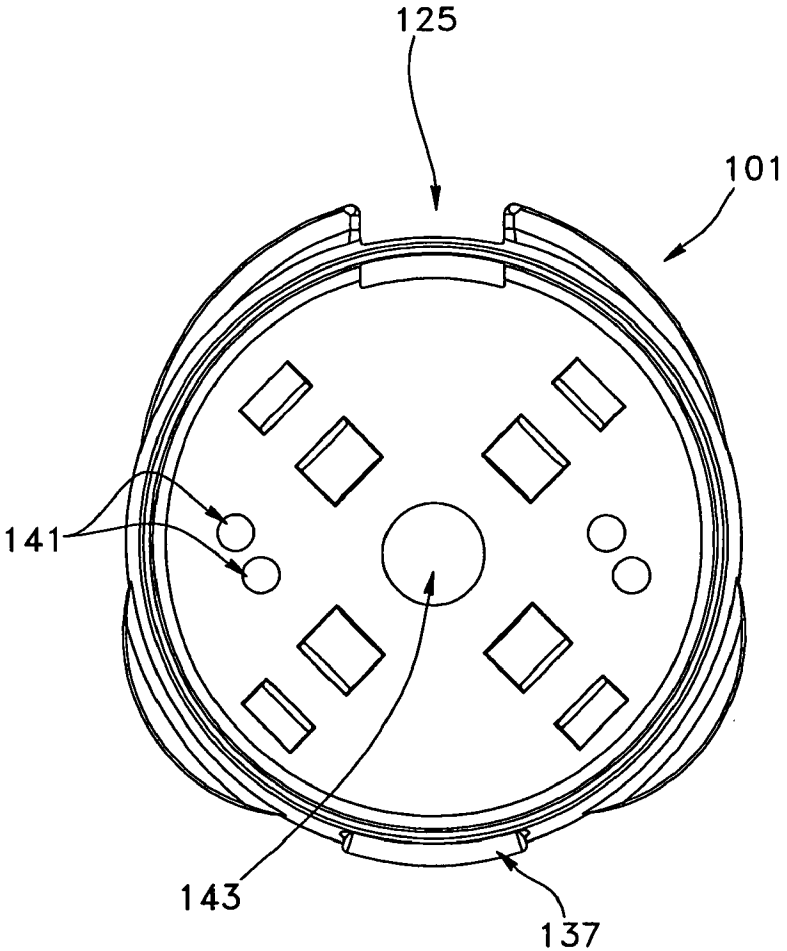
FIG. 13 is a rear plan view of the plug shown in FIG. 12.
Figure 12:
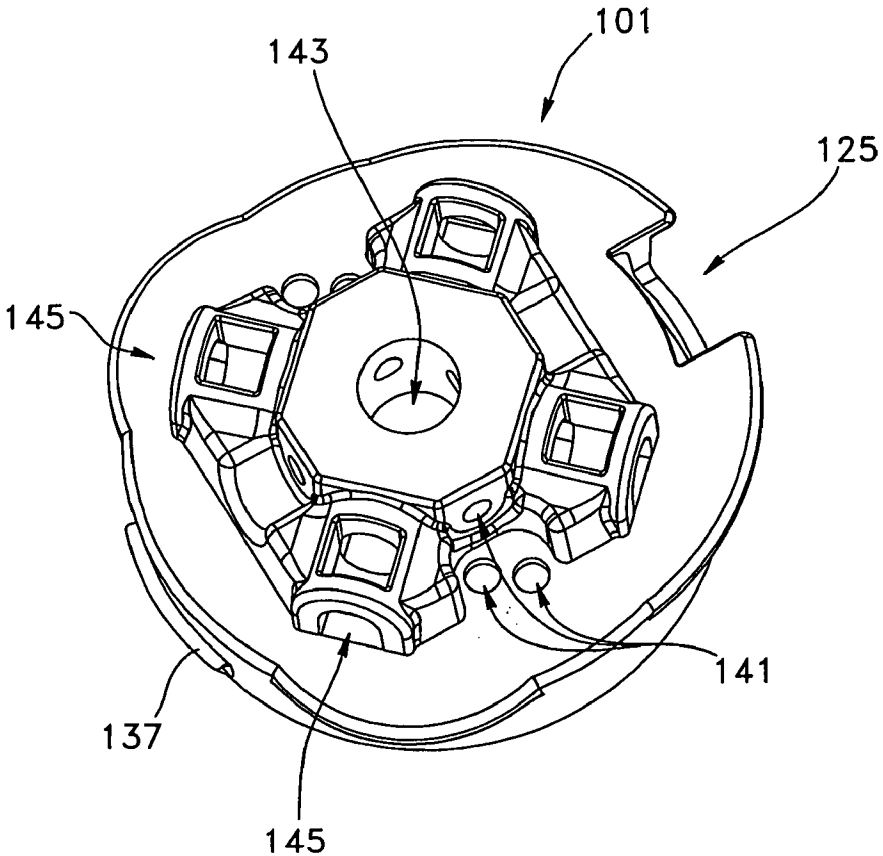
FIG. 12 is a perspective view of a plug according to another preferred embodiment of the present invention.

Once the spring coil has jumped over the wedge-like element, it rests over the spring opening (i.e. groove 125), as better shown in FIG. 10. The user then preferably heats the portion of the spring coil over the groove 125 and, with a hammer or any appropriate tool, bends the spring end into the slot 127 of the groove 125, as better shown in FIG. 11. Once the plug 101 is installed on one end of the spring 113, the user repeats the above operations for the opposite spring end using the complementary type of plug (stationary or winding). The spring 113 is then ready to be mounted around a shaft, for example, and to be used to counterbalance a garage door or any weight to be counterbalanced.

It is worth mentioning that several modifications could be made to the plug 101 without departing from the scope of the present invention. Indeed, the plug 101 according to the present invention may also be designed inversely with respect to the above-described embodiment. In such a case, the spring end would be bent before insertion of the plug 101 in the spring 113. The plug 101 would have no flange 137, tab, or wing, but instead, would have an embossment and a wedge-like element on the opposite side of the plug's groove 125. The insertion of the plug 101 would be done in the reverse way to the way described previously. A bending tang would be inserted in the spring hole and then the plug 101 would be rotated around this new point until the other spring side touches the plug with the special embossment shape. Then, the user would drive the plug 101 into the spring 113 using a hammer or any appropriate tool 147.

Figure 2:
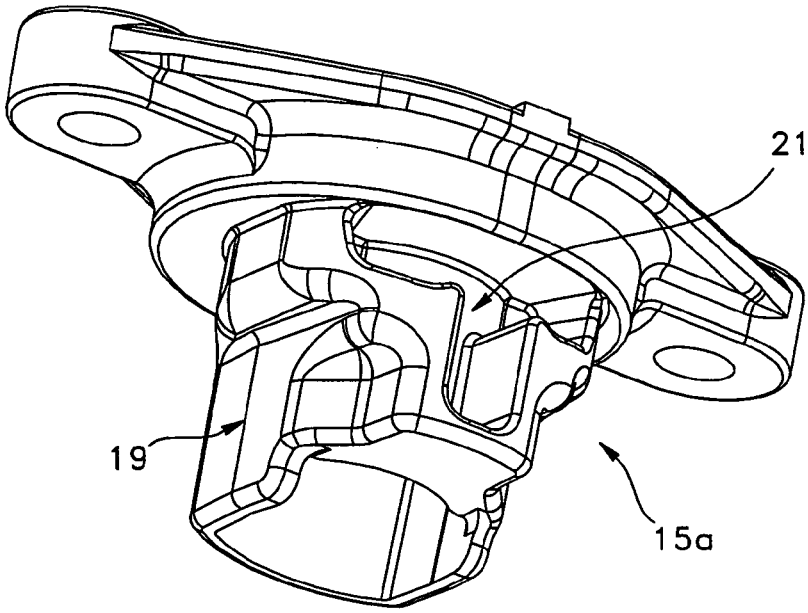
FIG. 2 (PRIOR ART)
FIG. 2 is a perspective view of a stationary plug according to a first embodiment of the prior art.
Figure 3:
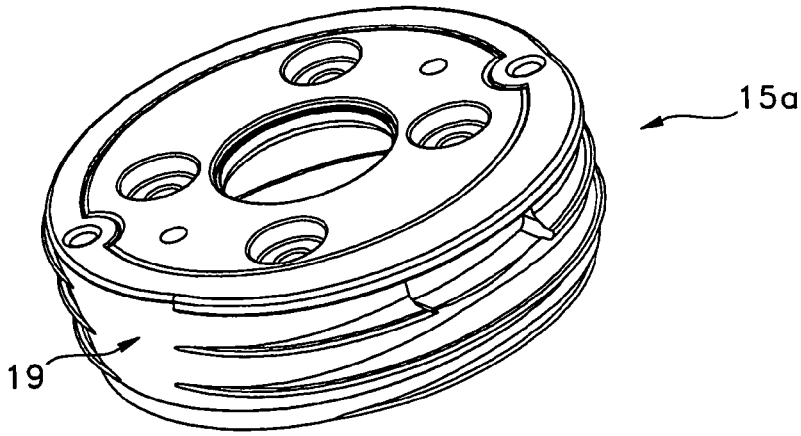
FIG. 3 (PRIOR ART)
FIG. 3 is perspective view of a stationary plug according to another embodiment of the prior art.
Figure 4:
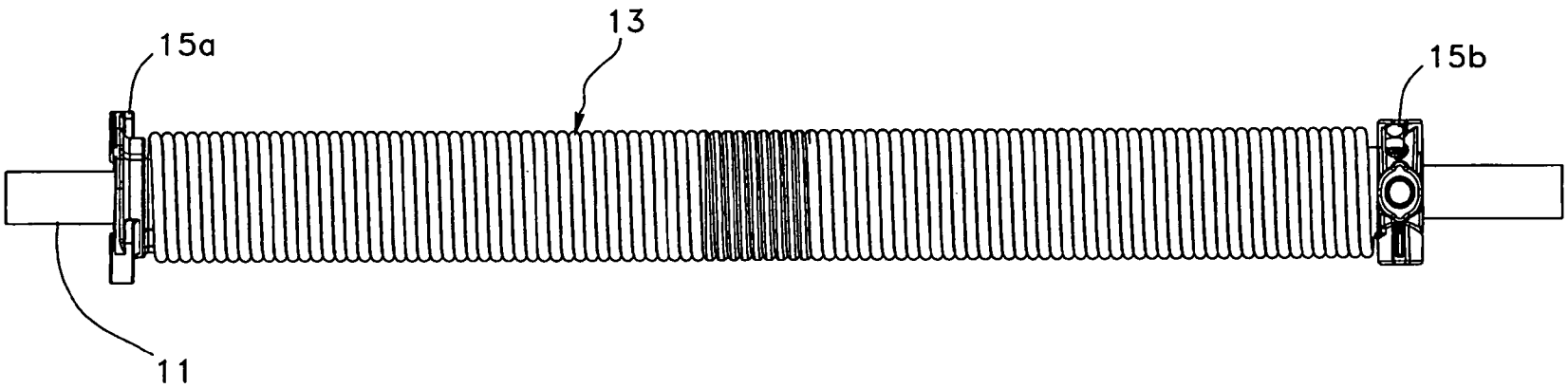
FIG. 4 (PRIOR ART)
FIG. 4 is a side view of a stationary plug and a winding plug according to the prior art, said stationary and winding plugs being shown cooperating respectively with an extremity of a torsion spring mounted about an overhead shaft of a counterbalancing mechanism according to the prior art.

As may now be better appreciated, the present invention is a substantial improvement and presents several advantages over devices and/or methods known on the prior art. Indeed, the present invention may be used in the garage door industry, with new door assemblies or existing door assemblies. The plug according to the present invention is particularly advantageous in that, by virtue of its design and components, as explained hereinabove, the plug 101 may be mounted onto the end of the torsional spring 113 in a clip-like manner, which reduces the installation time and physical requirements which would likely to be needed otherwise with conventional plugs 15 such as the ones illustrated in FIGS. 2 and 3.

Of course, numerous modifications could be made to the above-described embodiments without departing the scope of the invention, as defined in the appended claims.

What is claimed is:

1. A plug for a counterbalancing mechanism of a door assembly, the counterbalancing mechanism comprising a torsion spring, said torsion spring having a plurality coils, and an end portion including an end coil and a preceding coil adjacent to said end coil, the plug being used for operatively connecting the end portion of the torsion spring onto a corresponding component of the counterbalancing mechanism for allowing a torque transfer between the torsion spring and said corresponding component, the plug comprising:

connecting means for removably connecting the plug onto the corresponding component of the counterbalancing mechanism;

a substantially cylindrical collar insertable into the end portion of the torsion spring, the collar having a longitudinal axis and a peripheral side area extending about the longitudinal axis, the peripheral side area including diametrically opposite top and bottom portions;

anchoring means disposed on the bottom portion of the peripheral side area of the collar for cooperating with a coil of the end portion of the torsion spring, the anchoring means comprising a flange projecting from the bottom portion of the peripheral side area of the collar, the flange being shaped and sized for insertion between the end coil and the preceding coil of the end portion of the torsion spring so as to pivotably anchor the collar onto said end portion of the torsion spring; and a clip projecting from the top portion of the peripheral side area of the collar, at a location on the collar substantially diametrically opposite from where the anchoring means are disposed on the bottom portion of the peripheral side area, the clip being shaped and sized for clasping past the end coil of the torsion spring and operatively engaging with said end coil so as to securely mount the plug onto the end portion of the torsion spring in a clipping manner, the clip comprising a wedge having a slanted portion shaped and sized for pressure insertion into the end portion of the torsion spring past the end coil thereof, and a hooking portion opposite to the slanted portion for engaging with said end coil once the slanted portion is inserted past the end coil.

2. A plug according to claim 1, wherein the plug comprises a groove disposed on the top portion of the peripheral side area of the collar and positioned adjacent to the clip, the groove being shaped and sized for receiving a segment of the end coil of the torsion spring when the clip is clasped past the end coil and operatively engaged therewith.

3. A plug according to claim 2, wherein the plug further comprises a slot operatively connected to the groove, extending inside the collar towards the longitudinal axis thereof, for receiving an extremity of the end coil to be bent into said slot.

4. A plug according to claim 2, wherein the plug further comprises at least one stopper projecting from the top portion of the peripheral side area of the collar, positioned adjacent to the groove, far abutting against the end coil of the torsion spring.

5. A plug according to claim 1, wherein the flange of the anchoring means is substantially tapered for facilitating insertion at en angle between the end coil and the preceding coil of the end portion of the torsion spring.

6. A plug according to claim 1, wherein the anchoring means comprise a groove disposed on the bottom portion of the peripheral side area of the collar, at a location on the collar substantially diametrically opposite from where the clip projects from the top portion of the peripheral side area, the groove being shaped end sized for receiving a segment of the end coil of the torsion spring so as to pivotably anchor the collar onto said end portion of the torsion spring.

7. A plug according to claim 1, wherein the collar comprises an end covering provided with at least one hole for receiving a corresponding fastener for fastening the plug onto the corresponding component of the counterbalancing mechanism.

8. A plug according to claim 1, wherein the collar comprises an end covering provided with an orifice for receiving therethrough a shaft of the counterbalancing mechanism.

9. A plug according to claim 1, wherein the collar comprises an end covering provided with at least one socket for receiving a winding tool.

10. A plug according to claim 1, wherein the connecting means, the collar, the anchoring means, and the clip are integral to each other.

11. A door assembly having a counterbalancing mechanism comprising a torsion spring, said torsion spring having a plurality of coils, and an end portion including an end coil and a preceding coil adjacent to said end coil, the door assembly further having a plug used for operatively connecting the end portion of the torsion spring onto a corresponding component of the counterbalancing mechanism for allowing a torque transfer between the torsion spring and said corresponding component, the plug comprising:

connecting means for removably connecting the plug to the corresponding component of the counterbalancing mechanism;

a substantially cylindrical collar insertable into the end portion of the torsion spring, the collar having a longitudinal axis and a peripheral side area extending about the longitudinal axis, the peripheral side area including diametrically opposite top and bottom portions;

anchoring means disposed on the bottom portion of the peripheral side area of the collar for cooperating with a coil of the end portion of the torsion spring, the anchoring means comprising a flange projecting from the bottom portion of the peripheral side area of the collar, the flange being shaped and sized for insertion between the end coil and the preceding coil of the end portion of the torsion spring so as to pivotably anchor the collar onto said end portion of the torsion spring; and a clip projecting from the top portion of the peripheral side area of the collar, at a location on the collar substantially diametrically opposite from where the anchoring means are disposed on the bottom portion of the peripheral side area, the clip being shaped and sized for clasping past the end coil of the torsion spring and operatively engaging with said end coil so as to securely mount the plug onto the end portion of the torsion spring in a clipping manner, the clip comprising a wedge having a slanted portion shaped and sized for pressure insertion into the end portion of the torsion spring past the end coil thereof, and a hooking portion opposite to the slanted portion for engaging with said end coil once the slanted portion is inserted past the end coil.

12. A door assembly according to claim 11, wherein the plug comprises:

a groove disposed on the top portion of the peripheral side area of the collar and positioned adjacent to the clip, to groove being shaped and sized for receiving a segment of the end coil of the torsion spring when the clip is clasped past the end coil and operatively engaged therewith;

a slot operatively connected to the groove, extending inside the collar towards the longitudinal axis thereof, for receiving an extremity of the end coil to be bent into said slot; and at least one stopper projecting from the top portion of the peripheral side area of the collar, positioned adjacent to the groove, for abutting against the end coil of the torsion spring.

13. A plug according to claim 11, wherein the collar of the plug comprises an end covering provided with at least one bole for receiving a corresponding fastener for fastening the plug onto the corresponding component of the counterbalancing mechanism.

14. A method for operatively connecting a torsion spring onto a corresponding component of a counterbalancing mechanism of a door assembly, for allowing a torque transfer between the torsion spring and said corresponding component, the torsion spring having a plurality of coils, and an end portion including an end coil and a preceding coil adjacent to said end coil, the method comprising the steps of:

a) providing a plug according to claim 1;

b) anchoring the anchoring means of the plug onto a coil of the end portion of the torsion spring so as to pivotably anchor the collar of the plug onto said end portion of the torsion spring;

c) pivoting the collar of the plug about its anchoring means so as to rest the clip of the plug against the end coil, at a location on the end coil substantially diametrically opposite to where the anchoring means of the plug are inserted in step a);

d) clasping the clip of the collar past the end coil of the torsion spring and engaging with the same so as to securely mount the plug onto the end portion of the torsion spring in a clipping manner; and e) connecting the plug onto the corresponding component of the counterbalancing mechanism for allowing a torque transfer between the torsion spring and said corresponding component.

15. A method according to claim 14, wherein step d) comprises bending an extremity of the end coil into a slot of the collar.

16. A method according to claim 15, wherein the step of bending an extremity of the end coil into a slot of the collar comprises heating the extremity of the end coil prior to bending the extremity into the slot.

* * * * *